US011098440B2

(12) United States Patent
D'oliviera Dias et al.

(10) Patent No.: US 11,098,440 B2
(45) Date of Patent: Aug. 24, 2021

(54) APPARATUS FOR STEAM TREATMENT OF LAUNDRY COMPRISING A SUPPORT DEVICE

(71) Applicant: SEB S.A., Ecully (FR)

(72) Inventors: Laurent D'oliviera Dias, Saint Chamond (FR); Florent Peysselon, Lyons (FR); Nicolas Lauchet, Estrablin (FR)

(73) Assignee: SEB S.A., Ecully (FR)

( * ) Notice: Subject to any disclaimer, the term of this patent is extended or adjusted under 35 U.S.C. 154(b) by 147 days.

(21) Appl. No.: 16/433,464

(22) Filed: Jun. 6, 2019

(65) Prior Publication Data

US 2019/0376229 A1 Dec. 12, 2019

(30) Foreign Application Priority Data

Jun. 12, 2018 (FR) ..... 1855137

(51) Int. Cl.
*D06F 81/00* (2006.01)
*D06F 75/14* (2006.01)

(52) U.S. Cl.
CPC ..... *D06F 81/006* (2013.01); *D06F 75/14* (2013.01); *D06F 81/003* (2013.01)

(58) Field of Classification Search
CPC ..... D06F 81/00; D06F 81/12; D06F 81/006; D06F 75/14; D06F 79/00; D06F 79/02; D06F 79/023; D06F 81/003
See application file for complete search history.

(56) References Cited

U.S. PATENT DOCUMENTS 5,609,047 A * 3/1997 Hellman, Jr. ..... D06F 73/00 239/538
5,926,984 A * 7/1999 Zuber ..... D06F 81/003 38/107

(Continued)

FOREIGN PATENT DOCUMENTS

CN 205603917 U 9/2016
CN 108118517 A * 6/2018

(Continued)

OTHER PUBLICATIONS

Search Report as issued in French Patent Application No. 1855137, dated Feb. 13, 2019.

*Primary Examiner* — Ismael Izaguirre
(74) *Attorney, Agent, or Firm* — Lerner, David, Littenberg, Krumholz & Mentlik, LLP

(57) ABSTRACT

An apparatus for steam treatment of laundry includes a base containing a water reservoir, connected by a conduit to an ironing and/or smoothing tool including at least one hole for the emission of steam, at least one pole which supports a holding element on which a garment can be hung and/or supported in order to allow it to be treated using the tool, and a support device for placing the tool in a stable manner during inactive ironing and/or smoothing phases, the support device including an attachment member intended to cooperate with a first complementary attachment element supported by the pole in order to allow the support device to be removably attached to the pole, wherein the base includes a second complementary attachment element allowing the support device to be removably attached to the base.

16 Claims, 4 Drawing Sheets

(56) References Cited

U.S. PATENT DOCUMENTS

| | | | | |
|---|---|---|---|---|
| 8,132,346 | B1 * | 3/2012 | Cooper | D06F 79/02 38/107 |
| 8,205,363 | B2 * | 6/2012 | Lin | D06F 75/12 38/77.6 |
| 9,822,480 | B2 * | 11/2017 | Fung | D06F 87/00 |
| 2009/0255302 | A1 * | 10/2009 | Haan | D06F 73/00 68/222 |
| 2010/0058625 | A1 | 3/2010 | Lin et al. | |
| 2016/0047083 | A1 * | 2/2016 | Yoo | D06F 29/00 38/1 A |
| 2017/0321371 | A1 * | 11/2017 | Kuan | D06F 81/08 |

FOREIGN PATENT DOCUMENTS

| | | | |
|---|---|---|---|
| EP | 2 586 908 | A1 | 5/2013 |
| FR | 3 068 372 | A1 | 1/2019 |
| WO | WO 2013/000266 | A1 | 1/2013 |

* cited by examiner

APPARATUS FOR STEAM TREATMENT OF LAUNDRY COMPRISING A SUPPORT DEVICE

CROSS REFERENCE TO RELATED APPLICATIONS

This application claims priority to French Patent Application No. 1855137, filed Jun. 12, 2018, the entire content of which is incorporated herein by reference in its entirety.

FIELD

This invention relates to an apparatus for steam treatment of laundry comprising a base containing a water reservoir, connected by a conduit to an ironing and/or smoothing tool comprising at least one hole for the emission of steam. The invention relates more particularly to an apparatus comprising at least one pole which supports a hanging element on which a garment can be hung and/or supported to allow it to be treated using the tool, and comprising a support device for placing the tool in a stable manner during inactive ironing and/or smoothing phases.

BACKGROUND

From the Chinese utility model CN205603917U, we know of a smoothing apparatus comprising a base containing a water reservoir connected by a conduit to a smoothing head and two telescopic poles supporting a hanger on which a garment may be hung. This apparatus comprises a support device for placing the smoothing head, this support device being removable and able to be arranged according to different orientations on an arm in order to promote the ergonomics of use of the apparatus.

However, such a support device has the drawback of projecting on one side of the apparatus and of not making it possible to obtain a compact apparatus when the user wants to store the apparatus. In fact, even if the user lowers the poles as much as possible using the telescopic system in order to reduce the height of the apparatus, the tool will remain positioned on the support device which projects laterally, such that the conduit can easily become caught during transport or storage of the apparatus.

SUMMARY

Thus, one aspect of this invention is to propose an ironing/smoothing apparatus that corrects this drawback.

For this purpose, an aspect of the invention is directed to an apparatus for steam treatment of laundry comprising a base containing a water reservoir, connected by a conduit to an ironing and/or smoothing tool comprising at least one hole for the emission of steam, at least one pole which supports a holding element on which a garment can be arranged and/or supported in order to allow it to be treated using the tool, and a support device for placing the tool in a stable manner during inactive ironing and/or smoothing phases, the support device comprising an attachment member intended to cooperate with a first complementary attachment element supported by the pole in order to allow the support device to be removably attached to the pole, wherein the base comprises a second complementary attachment element allowing the support device to be removably attached to the base.

Such a characteristic makes it possible to arrange the support device directly on the base, which obtains a more compact assembly. In particular, when the tool rests on the base, the conduit connecting the tool to the base can be kept in the immediate vicinity of the base, such as by winding it around the latter, which reduces the risks that the conduit will become caught during transport or storage of the apparatus.

According to a beneficial characteristic of the invention, the base is removably arranged on a stand supporting the pole.

Such a characteristic makes it possible to obtain a removable base/tool assembly which can be used independently of the pole/holding element assembly designed to hang the garment to be ironed.

In particular, the fact that the support device can be attached directly to the base makes it possible to have an autonomous assembly that is easily transportable.

According to another beneficial characteristic of the invention, the base comprises a gripping handle for its transport.

Such a characteristic facilitates the transport of the removable base/tool assembly.

According to another beneficial characteristic of the invention, the attachment member is a bracket and the complementary attachment elements are orifices intended to receive the bracket.

Such an attachment system presents the benefit of being simple and economical to implement, while procuring good ergonomics of use.

According to another beneficial characteristic of the invention, the bracket is inserted in the orifice by a substantially vertical movement from top to bottom.

According to another beneficial characteristic of the invention, the first complementary attachment element is supported by an arm which extends transversally relative to the pole.

Such a characteristic makes it possible to shift the support device from the pole for a better ergonomics of use.

According to another beneficial characteristic of the invention, the first complementary attachment element allows the support device to be attached to a free extremity of the arm, the other extremity of the arm being attached to the pole.

According to another beneficial characteristic of the invention, the second complementary attachment element is arranged close to the upper extremity of the base, in particular at the edge of an upper surface of the base in an embodiment.

Such a characteristic makes it possible to offer good visibility of the complementary attachment element for better ergonomics of use.

According to another beneficial characteristic of the invention, the tool is an iron. Beneficially, the iron comprises a heating soleplate surmounted by a body comprising a gripping handle projecting on one side of the body, the gripping handle extending laterally relative to the soleplate and overhanging the latter.

According to another beneficial characteristic of the invention, the support device comprises a body made of plastic material and presenting a surface equipped with thermally insulating pads against which the tool is intended to rest.

Such a characteristic makes it possible to obtain a support device that is inexpensive to manufacture and is light.

According to another beneficial characteristic of the invention, the holding element supported by the pole is a hanger and/or an ironing board.

According to another beneficial characteristic of the invention, the ironing board is mounted such that it can pivot on the pole by means of a hinge device allowing the ironing board to be immobilized in various tilted positions.

According to another beneficial characteristic of the invention, the apparatus comprises a hanger hanging device arranged at an upper extremity of the ironing board, when the latter is in a vertical position, the hanger hanging device comprising a third complementary attachment element allowing the support device to be removably attached when the ironing board is in an inclined or horizontal position.

According to another beneficial characteristic of the invention, the hinge device allows the ironing board to be immobilized in at least one horizontal position, one vertical position and one intermediate position between the vertical position and the horizontal position.

Such a characteristic allows the appliance's ergonomics of use to be optimized by offering three positions with three very different ergonomics of use.

According to another beneficial characteristic of the invention, the pole is telescopic.

Such a characteristic allows the height of the ironing board to be adjusted.

According to another beneficial characteristic of the invention, the pole is arranged vertically.

According to another beneficial characteristic of the invention, the apparatus comprises two parallel poles which support the ironing board.

According to another beneficial characteristic of the invention, the first attachment element allows the support device to be attached in a position in which the plane passing through the two poles constitutes a plane of symmetry of the support device.

According to another beneficial characteristic of the invention, the base comprises an electric pump allowing water to be sent from the reservoir toward the smoothing tool, the smoothing tool comprising an instant steaming chamber.

Such a characteristic makes it possible to have a base that is compact and very simple to make, the steam being produced directly in the steaming chamber supported by the smoothing tool.

BRIEF DESCRIPTION OF THE DRAWINGS

The objects, aspects, and benefits of this invention will be more fully understood in consideration of the following description of a particular embodiment of the invention presented as a non-restrictive example, by referring to the attached drawings in which.

DETAILED DESCRIPTION

Only the elements necessary for understanding the invention have been represented. To facilitate reading of the drawings, the same elements bear the same references from one figure to the next. Note that in this document, the terms "horizontal," "vertical," "lower," "upper," "front" and "back" used to describe the apparatus refer to this apparatus when it is resting flat on its stand as illustrated in FIG. 1.

Figure 1:
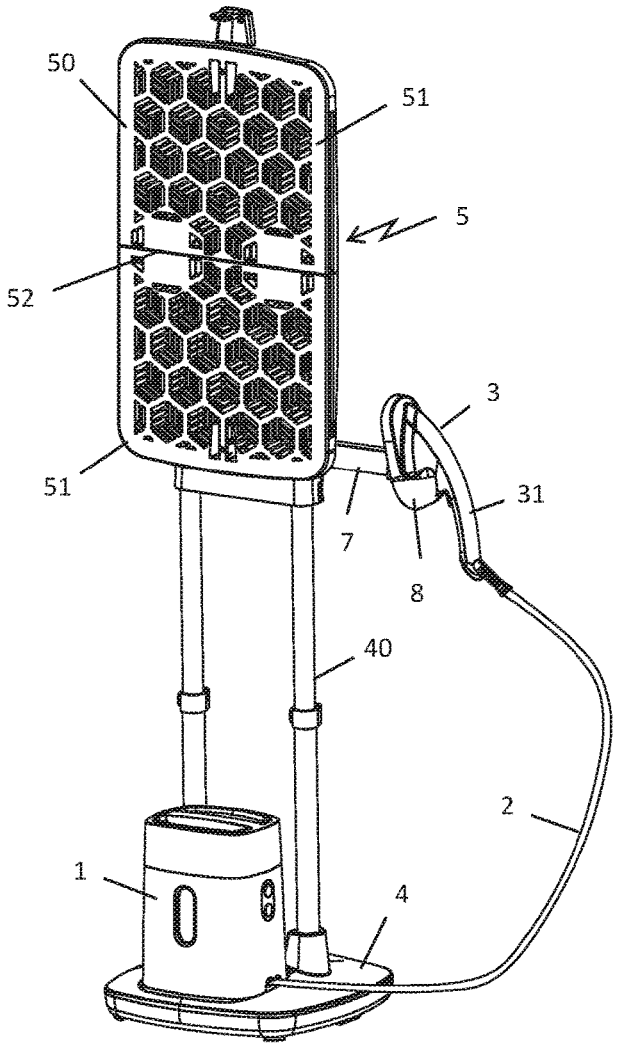
FIGS. 1 and 2 are perspective views of an ironing apparatus according to a particular embodiment of the invention.
Figure 2:
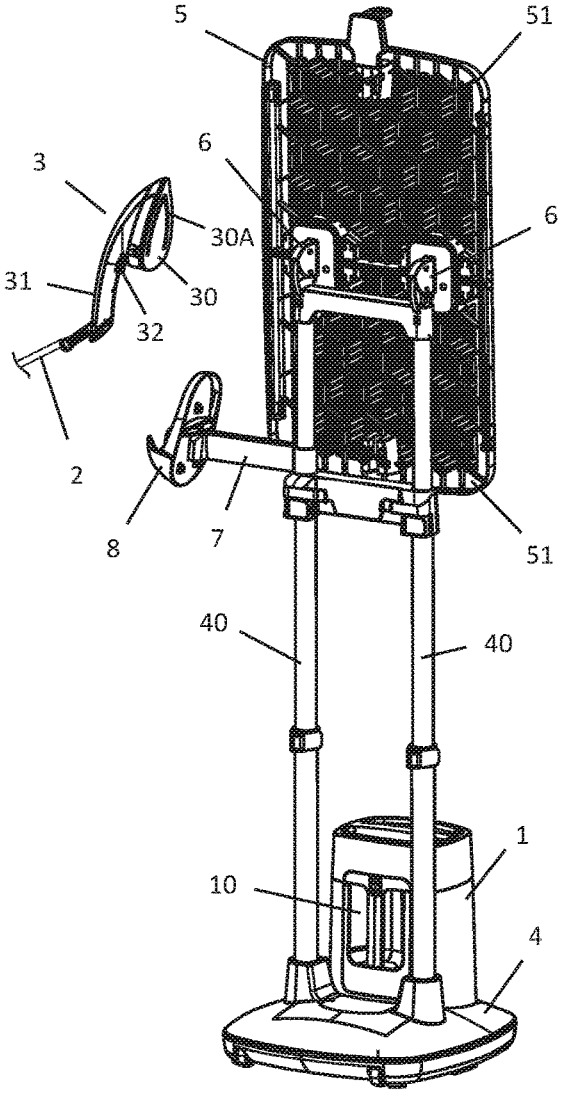

FIGS. 1 and 2 represent a steam ironing apparatus comprising a portable base 1 connected by a flexible conduit 2 to a steam iron 3, the base 1 being electrically connected to a household network by a cable, not visible in the figures.

The base 1 comprises a removable reservoir 10 and a pump which draws water from the reservoir 10 to send it to the iron 3 through a pipe integrated in the conduit.

The iron 3 comprises, in a manner known per se, a flat soleplate 30 surmounted by a body which comprises a gripping handle 31 comprising a free rear extremity projecting laterally relative to the body. The body contains, in a manner known per se, a casting which is in thermal contact with the soleplate and comprises a heating resistor, controlled by means of a non-adjustable thermostat, allowing the temperature of the soleplate 30 to be maintained around a setpoint temperature of approximately 135° C. (i.e. +/−10° C.).

The casting is beneficially made of aluminum and it comprises an instant steaming chamber into which the water coming from the reservoir 10 is injected by the pump, the operation of the pump being controlled by a trigger 32 arranged under the front extremity of the handle 31. The pump and the steaming chamber are beneficially sized to allow the production of a continuous steam flow of approximately 25 g/min (i.e. +/−5 g/min) when the trigger 32 is actuated, the soleplate 30 traditionally comprising holes 30A for the emission of steam.

The apparatus also comprises a stand 4 on which the base 1 rests removably, the latter being equipped with a handle 11 at its upper extremity to facilitate its transport. The stand 4 beneficially comprises a recess 41, visible on FIG. 3, following the external contour of the base and in which the lower extremity of the base 1 engages.

In an embodiment, the stand 4 comprises two telescopic poles 40 comprising an upper extremity supporting a rigid ironing board 5 comprising a smoothing surface 50, for example flat, intended to be covered with a slipcover, not represented in the figures, and on which laundry to be smoothed can be placed.

The ironing board 5 is mounted such that it can pivot on the extremity of the poles 40 by means of a hinge device 6 allowing the ironing board 5 to be immobilized in different tilted positions and beneficially in a vertical position (illustrated in FIGS. 1 and 2), in a horizontal position, and in an intermediate position in which the ironing board 5 beneficially forms an angle of approximately 40° (i.e. +/−7°) with respect to the vertical.

This hinge device 6 is, for example, conforming to the one described in greater detail in the patent application filed in France by the applicant under the filing number FR 1756063, which is incorporated herein by reference.

Figure 4:
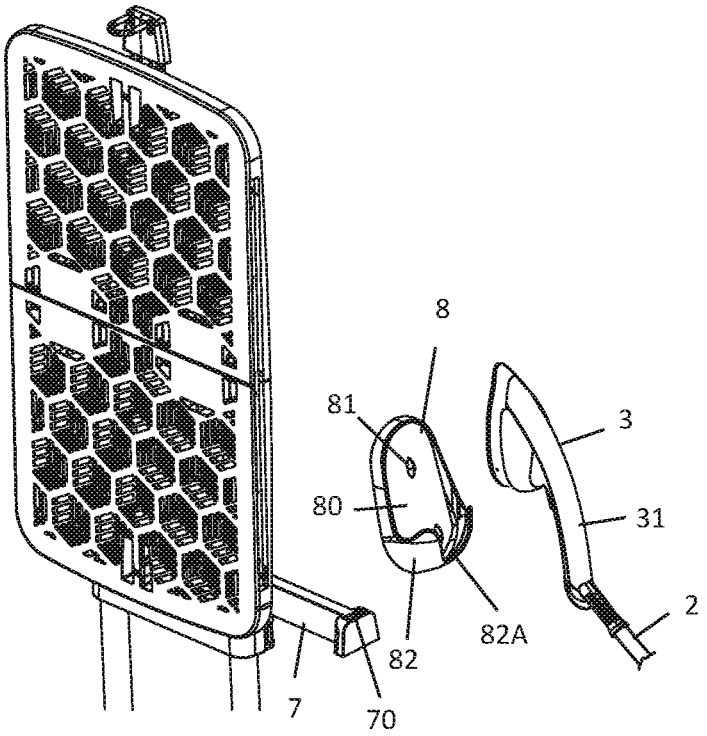
FIG. 4 is a perspective view of the ironing board with the support device removed from the arm attached to the pole.

In accordance with FIGS. 2 and 4, one of the telescopic poles 40 supports a cross arm 7 at the extremity of which is arrange a support device 8 on which the iron 3 can be placed during inactive ironing/smoothing phases.

The support device 8 comprises a body made of plastic material presenting a flat surface 80 comprising thermally insulating pads 81 against which the soleplate 30 is intended to rest when the iron 3 rests on the support device 8.

The support device 8 also comprises a skirt 82 which borders the lower extremity of the surface 80 and which has a shape adapted to hold in a stable manner the iron 3 on the support device 8 when the surface 80 forms an angle of approximately 15° (i.e. +/−3°) with respect to the vertical plane, the skirt 82 presenting an indentation 82A in its median portion for passage of the handle 31 of the iron.

Figure 5:
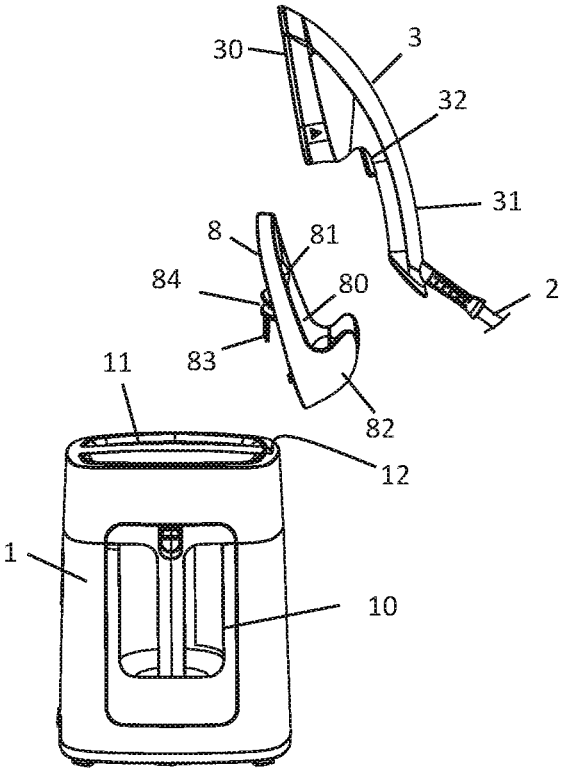
FIGS. 5 and 6 are perspective views of the base and the support device.
Figure 6:
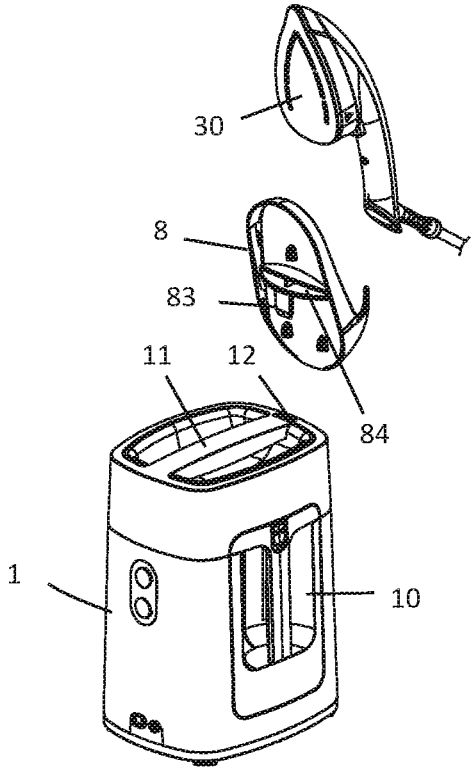

In accordance with FIGS. 4 to 6, the support device 8 comprises an attachment member 83 allowing it to be attached to the arm 7 and the base 1, this attachment member beneficially consisting of a bracket 83 extending substantially vertically (i.e. with an angle of +/−10° with respect to the vertical direction) and presenting an upper extremity connected to a cross member 84 arranged behind the surface 80, the bracket 83 comprising a free lower surface.

Figure 3:
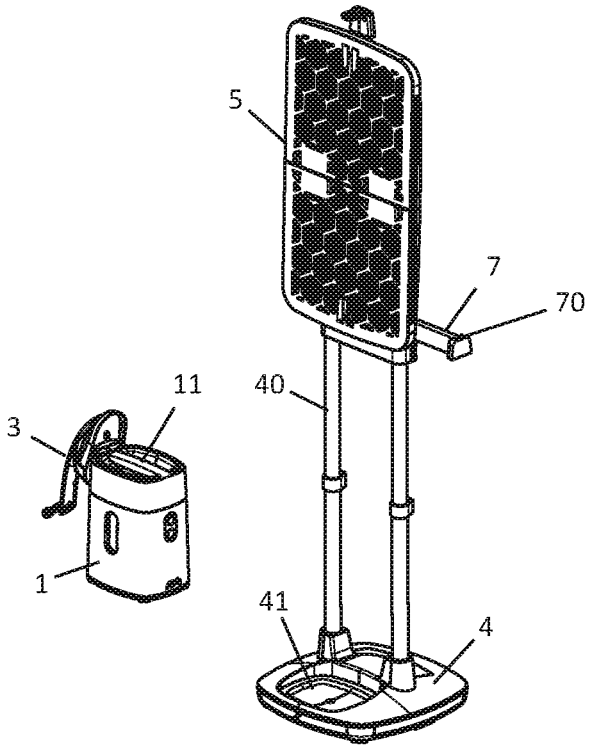
FIG. 3 is a perspective view of the apparatus with the base removed from the stand and the support device hung on the base.

This bracket 83 may engage in a first orifice 70 having a complementary shape and arranged at the extremity of the arm 7, illustrated in FIGS. 3 and 4, in order to allow the support device 8 to be arranged close to the ironing board 5. In an embodiment, the first orifice 70 allows the support device 8 to be oriented in a lateral position, illustrated in FIGS. 1 and 2, in which the iron 3 may be engaged on the support device 8 by orienting the soleplate 30 perpendicularly to the vertical plane of the ironing board 5. Such an orientation of the support device 8 has the benefit of offering the same ergonomics of use whether the user is in front of or behind the board during the vertical smoothing operation.

Figure 7:
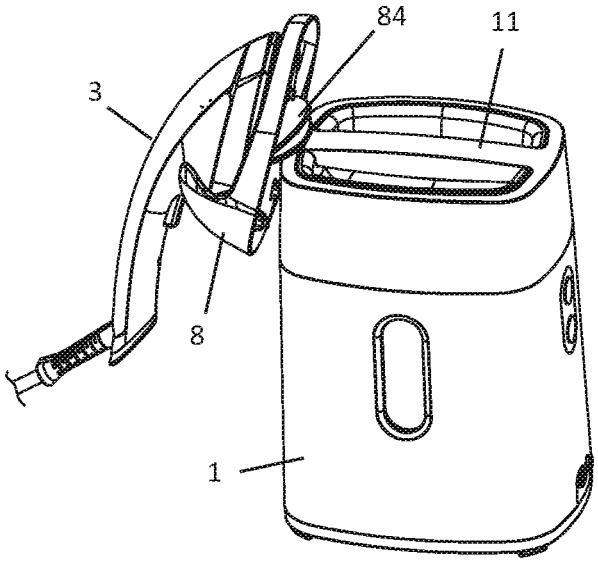
FIG. 7 is a perspective view of the support device coupled to the base.

In accordance with FIGS. 5 to 7, the bracket 83 can also engage in a second orifice 12, having a shape similar to that of the first orifice 70, arranged at the upper extremity of the base 1.

This second orifice 12 is beneficially arranged on the upper surface of the base 1, at the edge of the latter, such that the base 1 can be transported using only one hand by its handle 11 with the iron 3 placed on the support device 8 hung on the edge of the base 1, as illustrated in FIG. 7.

Figure 8:
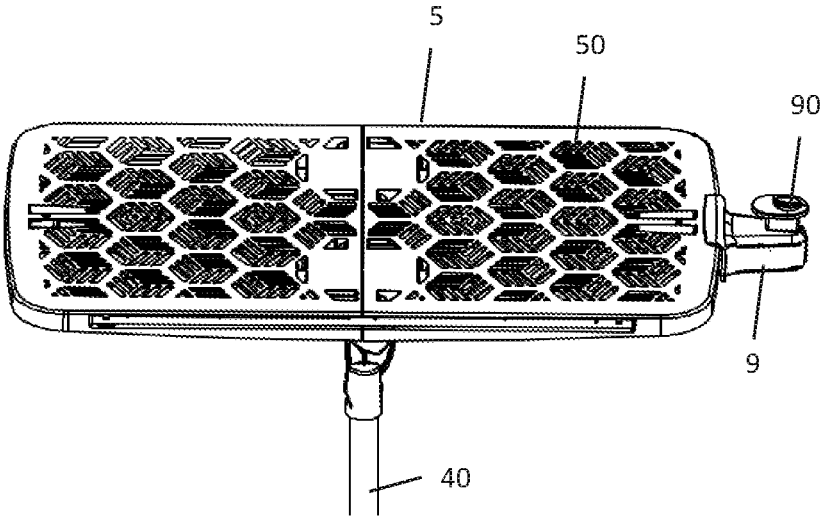
FIG. 8 is a perspective view of an embodiment variant of the ironing board equipped with a hanger hanging pin designed to allow the attachment of the support device, the ironing board being represented in the horizontal position.
Figure 9:
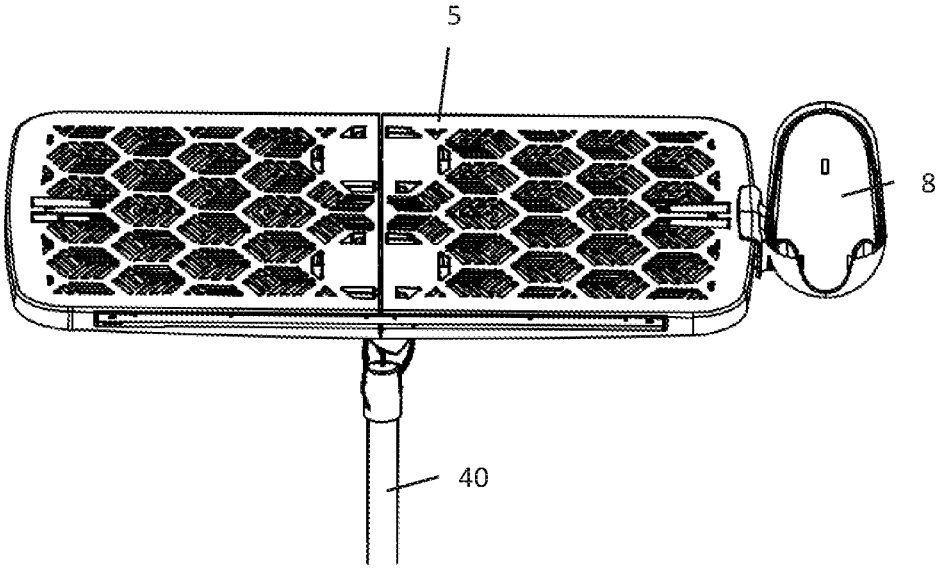
FIG. 9 is a similar view to that of FIG. 7 with the support device attached to the hanger hanging pin.

In accordance with FIGS. 8 and 9, the bracket 83 can also engage in a third orifice 90, having a shape similar to that of the first and second orifices 12, 70 arranged on a hanger hanging pin 9 allowing a hanger, not represented in the figures, to be hung at the upper extremity of the ironing board 5 when the latter is in the vertical position so that the garment hung on the hanger extends in front of the smoothing surface 50.

Thus, when the ironing board 5 is arranged horizontally, as represented in FIGS. 8 and 9, the support device 8 can be hung directly on the hanger hanging pin 9 and be in the immediate proximity of the smoothing surface 50.

The apparatus thus realized has the benefit of having great ergonomics of use while being very economical to make.

In fact, in a first configuration of use, the steam production assembly, consisting of the base 1 combined with the iron 3, can be used in combination with the stand 4 and the ironing table 5 to perform smoothing work very efficiently. In this case, the user can place the support device 8 at the end of the arm 7, or on the hanger hanging pin 9 when the ironing board 5 is arranged horizontally, which allows the user to be able to use this support device 8 in order to place the iron 3, when necessary, in the immediate proximity of the ironing board 5.

In a second configuration, the steam production assembly, consisting of the base 1 combined with the iron 3, can be used alone and can be transported easily by means of its handle 11 by attaching the support device 8 to the base 1. In this configuration of use, the base 1 may, for example, be used by being placed on a table such that the support device 8 remains easily accessible for the user.

It will be appreciated that the invention is in no way limited to the embodiment described and illustrated, which has been provided only as an example. Modifications are still possible, in particular from the point of view of the composition of the various components or by substitution of equivalent techniques, without departing from the scope of protection of the invention.

Thus, in one embodiment variant not represented, the attachment member of the support device may be formed of a magnet cooperating with a first metal plate supported by the pole and a second metal plate supported by the base.

Thus, in an embodiment variant not represented, the first complementary attachment element may be arranged directly in the ironing board.

Thus, in an embodiment variant not represented, the ironing board may be supported by a single pole.

Thus, in another embodiment not represented. the base may generate steam and be connected by a conduit to a steam-emitting smoothing brush emitting.

The invention claimed is:

1. An apparatus for steam treatment of laundry comprising a base containing a water reservoir, connected by a conduit to an ironing and/or smoothing tool comprising at least one hole for the emission of steam, at least one pole which supports a holding element on which a garment can be hung and/or supported in order to allow it to be treated using the tool, and a support device for placing the tool in a stable manner during inactive ironing and/or smoothing phases, the support device comprising an attachment member adapted to cooperate with a first complementary attachment element supported by the pole in order to allow the support device to be removably attached to the pole, wherein the base comprises a second complementary attachment element allowing the support device to be removably attached to the base.

2. The apparatus according to claim 1, wherein in that the base is removably arranged on a stand supporting the pole.

3. The apparatus according to claim 2, wherein the base comprises a gripping handle for its transport.

4. The apparatus according to claim 1, wherein the attachment member is a bracket and wherein the complementary attachment elements are orifices intended to receive the bracket.

5. The apparatus according to claim 4, wherein the bracket is inserted in the orifice by a substantially vertical movement from top to bottom.

6. The apparatus according to claim 2, wherein the first complementary attachment element is supported by an arm which extends transversally relative to the pole.

7. The apparatus according to claim 6, wherein the first complementary attachment element allows the support device to be attached to a free extremity of the arm, the other extremity of the arm being attached to the pole.

8. The apparatus according to claim 1, wherein the second complementary attachment element is arranged close to the upper extremity of the base.

9. The apparatus according to claim 8, wherein the second complementary attachment element is arranged at the edge of an upper surface of the base.

10. The apparatus according to claim 1, wherein the tool is an iron.

11. The apparatus according to claim 1, wherein the support device comprises a body made of plastic material and presenting a surface equipped with thermally insulating pads against which the tool is intended to rest.

12. The apparatus according to claim 1, wherein the holding element is an ironing board.

13. The apparatus according to claim 12, wherein the ironing board is mounted such that the ironing board is pivotable on the pole by means of a hinge device allowing the ironing board to be immobilized in various tilted positions.

14. The apparatus according to claim 12, further comprising a hanger hanging device arranged at an upper extremity of the ironing board when the ironing board is in a vertical position and wherein the hanger hanging device comprises a third complementary attachment element allowing the support device to be removably attached when the ironing board is in a horizontal position.

15. The apparatus according to claim 12, comprising two parallel poles which support the ironing board.

16. The apparatus according to claim 15, wherein the first attachment element allows the support device to be attached in a position in which the plane passing through the two poles constitutes a plane of symmetry of the support device.

* * * * *